US008016056B2

(12) United States Patent
Viswanadham et al.

(10) Patent No.: US 8,016,056 B2
(45) Date of Patent: Sep. 13, 2011

(54) ASYMMETRIC GRADED COMPOSITES FOR IMPROVED DRILL BITS

(75) Inventors: Ramamurthy K. Viswanadham, Spring, TX (US); Dah-Ben Liang, Woodlands, TX (US); Gregory T. Lockwood, Pearland, TX (US)

(73) Assignee: Sandvik Intellectual Property AB, Sandviken (SE)

( * ) Notice: Subject to any disclaimer, the term of this patent is extended or adjusted under 35 U.S.C. 154(b) by 188 days.

(21) Appl. No.: 11/478,559

(22) Filed: Jun. 29, 2006

(65) Prior Publication Data

US 2007/0000699 A1 Jan. 4, 2007

Related U.S. Application Data

(60) Provisional application No. 60/696,061, filed on Jul. 1, 2005.

(51) Int. Cl.
*E21B 10/36* (2006.01)

(52) U.S. Cl. ..... 175/374; 175/425; 175/431

(58) Field of Classification Search ..... 175/426, 175/431, 432, 430, 374, 425; 76/108.1, 108.2, 76/108.4

See application file for complete search history.

(56) References Cited

U.S. PATENT DOCUMENTS

| | | | | |
|---|---|---|---|---|
| 3,306,381 | A * | 2/1967 | Garrett et al. | 175/346 |
| 4,268,582 | A | 5/1981 | Hale et al. | |
| 4,368,788 | A * | 1/1983 | Drake | 175/374 |
| 4,934,467 | A | 6/1990 | Langford, Jr. | |
| 4,961,780 | A | 10/1990 | Pennington, Jr. | |
| 5,116,416 | A | 5/1992 | Knox et al. | |
| 5,499,688 | A * | 3/1996 | Dennis | 175/426 |
| 5,607,024 | A * | 3/1997 | Keith et al. | 175/431 |
| 5,752,573 | A * | 5/1998 | Scott et al. | 175/374 |
| 5,988,302 | A | 11/1999 | Sreshta et al. | |
| 6,227,318 | B1 | 5/2001 | Siracki | |
| 6,241,035 | B1 * | 6/2001 | Portwood | 175/374 |
| 6,510,910 | B2 * | 1/2003 | Eyre et al. | 175/430 |
| 6,869,460 | B1 | 3/2005 | Bennett et al. | |
| 2006/0042837 | A1 | 3/2006 | Bandi | |

FOREIGN PATENT DOCUMENTS

| | | |
|---|---|---|
| EP | 0111600 | 6/1984 |

OTHER PUBLICATIONS

European Search Report dated Oct. 16, 2006 and issued in EP Application No. 06116442.2 (4 pages).

Canadian Office Action for related Application No. 2,551,389 dated Sep. 20, 2009. (2 pages).

* cited by examiner

*Primary Examiner* — Kenneth Thompson

(74) *Attorney, Agent, or Firm* — Osha Liang LLP

(57) ABSTRACT

A cutting tool that includes at least one tungsten carbide cutting element disposed on a support, wherein at least one tungsten carbide cutting element has at least one localized region having a material property different from the remaining region, wherein the at least one localized region having a different material property is prepared by a method including determining at least one localized region needing a variation in a material property different from the remaining region; coating a portion of a surface of the at least one tungsten carbide cutting element with a refractory material such that a surface corresponding to the localized region is left uncoated; and treating the coated cutting element with a selected agent to diffuse the selected agent into the localized region is disclosed.

12 Claims, 8 Drawing Sheets

ASYMMETRIC GRADED COMPOSITES FOR IMPROVED DRILL BITS

CROSS-REFERENCE TO RELATED APPLICATION

This application, pursuant to 35 U.S.C. §119(e), claims priority to U.S. Provisional Application Ser. No. 60/696,061, filed on Jul. 1, 2005. That application is incorporated by reference in its entirety.

BACKGROUND OF INVENTION

1. Field of the Invention

The invention relates generally to methods for providing improved drill bits. In particular, the present invention relates to methods for generating localized and/or asymmetrically graded compositions in cutting elements.

2. Background Art

Roller cone rock bits and fixed cutter bits are commonly used in the oil and gas industry for drilling wells. FIG. 1 shows one example of a conventional drilling system drilling an earth formation. The drilling system includes a drilling rig 10 used to turn a drill string 12, which extends downward into a well bore 14. Connected to the end of the drill string 12 is roller cone-type drill bit 20, shown in further detail in FIG. 2.

As shown in FIG. 2, a roller cone bit 20 typically comprises a bit body 22 having an externally threaded connection at one end 24, and a plurality of roller cones 26 (usually three as shown) attached to the other end of the bit body 22 and able to rotate with respect to the bit body 22. Attached to the roller cones 26 of the bit 20 are a plurality of cutting elements 28, typically arranged in rows about the surface of the roller cones 26. The cutting elements 28 can be inserts, polycrystalline diamond compacts, or milled steel teeth. If the cutting elements 28 are milled steel teeth, they may be coated with a hardfacing material. One particular type of insert uses tungsten carbide and thus are known as TCI.

Many factors affect the durability of a TCI bit in a particular application. These factors include the chemical composition and physical structure (size and shape) of the carbides, the chemical composition and microstructure of the matrix metal or alloy, and the relative proportions of the carbide materials to one another and to the matrix metal or alloy.

Many different types of tungsten carbides are known based on their different chemical compositions and physical structure. Three types of tungsten carbide commonly used in manufacturing drill bits are cast tungsten carbide, macrocrystalline tungsten carbide, and cemented tungsten carbide (also known as sintered tungsten carbide).

Cemented carbides, as exemplified by WC—Co, have a unique combination of high elastic modulus, high hardness, high compressive strength, and high wear and abrasion resistance with reasonable levels of fracture toughness. See Brookes, Kenneth J. A., "*World Directory and Handbook of Hardmetals and Hard Materials*," International Carbide Data, 1997. This unique combination of properties makes them ideally suited for a variety of industrial applications, such as drill bits. See "*Powder Metal Technologies and Applications, Powder Metallurgy Cermets and Cemented Carbides, section on Cemented Carbides*," Metals Handbook, Vol. 7, ASM International, Metals Park, Ohio, 1998, pp. 933-937. The very high modulus of WC, its ability to plastically deform at room temperature, excellent wetting of WC by cobalt, good solubility and reasonable diffusivity of W and C in cobalt, retention of the face centered cubic form of cobalt in the as sintered condition all contribute to this versatility.

Attempts to develop alternate cemented carbide systems that can provide higher levels of fracture toughness for a given hardness (resistance to wear) have only resulted in limited success. These alternate materials often find niche applications but lack the versatility of WC—Co. See Viswanadham et al., "*Transformation Toughening in Cemented Carbides, I. Binder Composition Control*", Met. Trans. A. Vol. 18A, 1987, p. 2163; and "*Transformation Toughening in Cemented Carbides, II. Themomechanical Treatments*", Met. Trans. A., Vol. 18A, 1987, p. 2175.

Property changes in WC—Co and other similar systems are often accomplished by variations in binder contents and/or grain sizes. Higher binder contents and larger grain sizes lead to increased fracture toughness at the expense of wear resistance (hardness), and vice versa. This inverse relationship between the wear resistance and fracture toughness of these materials makes the selection of a particular cemented carbide grade for a given application an exercise in compromise between resistance to wear and resistance to catastrophic crack growth.

Over the years, many attempts have been made to increase the fracture resistance of WC—Co without sacrificing wear resistance. Two approaches have produced successful results: (1) producing surface compressive stresses through mechanical means; and (2) producing dual-property cemented carbides by carburizing carbon-deficient cemented carbides (WC—Co) having uniformly distributed eta carbide. The mechanically imposed compressive stresses increase the apparent fracture toughness with essentially no change in wear resistance. Dual-property carbides, such as the DP™ carbides from Sandvik AB Corporation (Sandviken, Sweden), have carbon gradients near the surface during processing, which result in binder (Co) depletion near the surface that results in significant residual surface compressive stress. The high level of compressive stress results in an increase in the apparent fracture toughness of the material, while the wear resistance also increases due to lower binder contents near the surface.

While these prior art treatments are capable of producing improved inserts, they are applied to the entire insert and are not suitable for localized variations in material properties of an insert (cutting element). Therefore, there still exists a need for methods that can provide localized variations in material properties in an insert.

SUMMARY OF INVENTION

One aspect of the invention relates to a cutting tool that includes at least one tungsten carbide cutting element disposed on a support, wherein at least one tungsten carbide cutting element has at least one localized region having a material property different from the remaining region, wherein the at least one localized region having a different material property is prepared by a method including determining at least one localized region needing a variation in a material property different from the remaining region; coating a portion of a surface of the at least one tungsten carbide cutting element with a refractory material such that a surface corresponding to the localized region is left uncoated; and treating the coated cutting element with a selected agent to diffuse the selected agent into the localized region.

Another aspect the invention relates a cutting tool that includes at least one gage element disposed on a support, wherein at least one gage element has at least one localized region having a material property different from the remaining region, wherein the at least one localized region having a different material property is prepared by a method including determining at least one localized region needing a variation in a material property different from the remaining region; coating a portion of a surface of the at least one gage element with a refractory material such that a surface corresponding to the localized region is left uncoated; and treating the coated cutting element with a selected agent to diffuse the selected agent into the localized region.

Yet another aspect of the invention relates to a method that includes determining at least one localized region of a tungsten carbide cutting element needing a variation in a material property different from the remaining region; coating at least one area on a surface of the tungsten carbide cutting element with a refractory material, wherein the coating leaves at least one uncoated area on the surface of the tungsten carbide cutting element; and treating the coated cutting element with a selected agent to diffuse the selected agent into the at least one uncoated area, creating a binder gradient in the tungsten carbide cutting element in the at least one uncoated area.

Other aspects and advantages of the invention will be apparent from the following description and the appended claims.

DETAILED DESCRIPTION

Embodiments of the invention relate to methods for producing localized variations in the material properties of inserts (cutting elements). Some embodiments of the invention relate to drill bits that include inserts having localized gradients of material compositions therein, wherein the gradients of material compositions comprising gradients of the binder (e.g., cobalt) in the tungsten carbide. Some embodiments of the invention provide methods for altering material properties of an insert locally and/or asymmetrically by generating areas with variations in the material compositions. Being able to generate localized variations in material properties on an insert is desirable. For example, lower binder content regions may be generated locally (e.g., on the cutting surface of an insert) to have increased wear resistance without significantly lowering fracture toughness.

Figure 1:
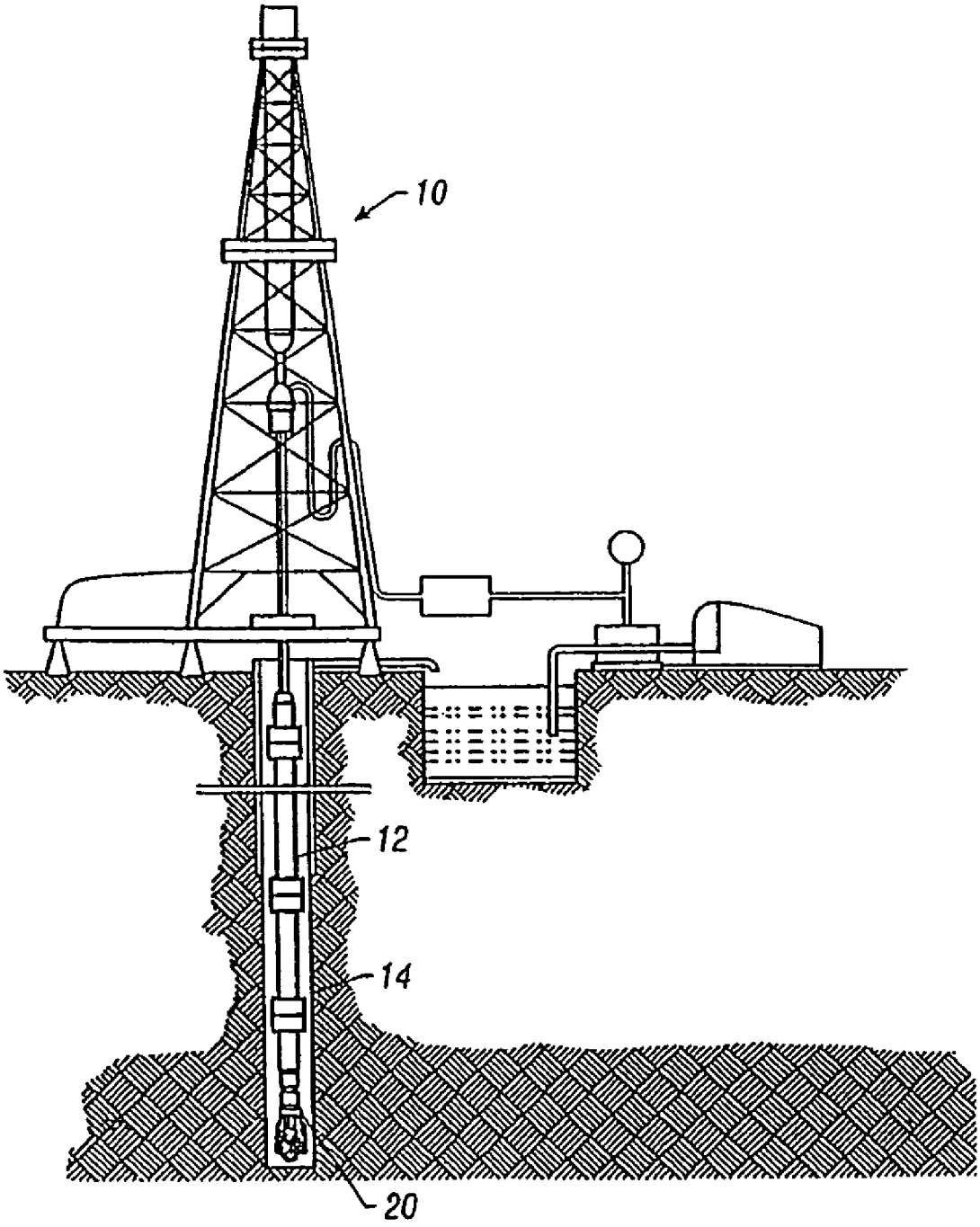
FIG. 1 (Prior Art)
FIG. 1 shows an example of a conventional drill system drilling an earth formation.
Figure 2:
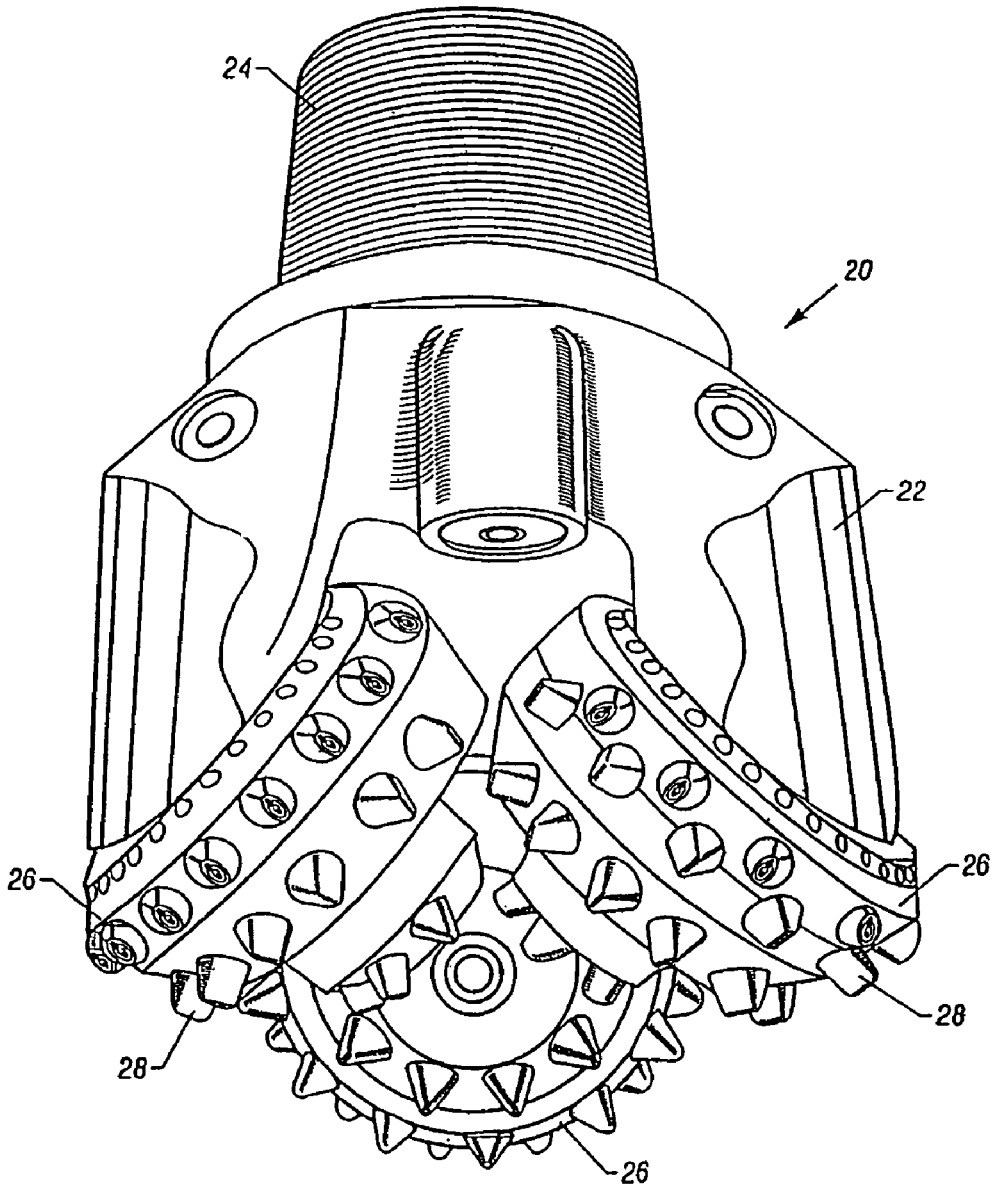
FIG. 2 (Prior Art)
FIG. 2 shows a conventional roller cone drill bit.
Figure 3:
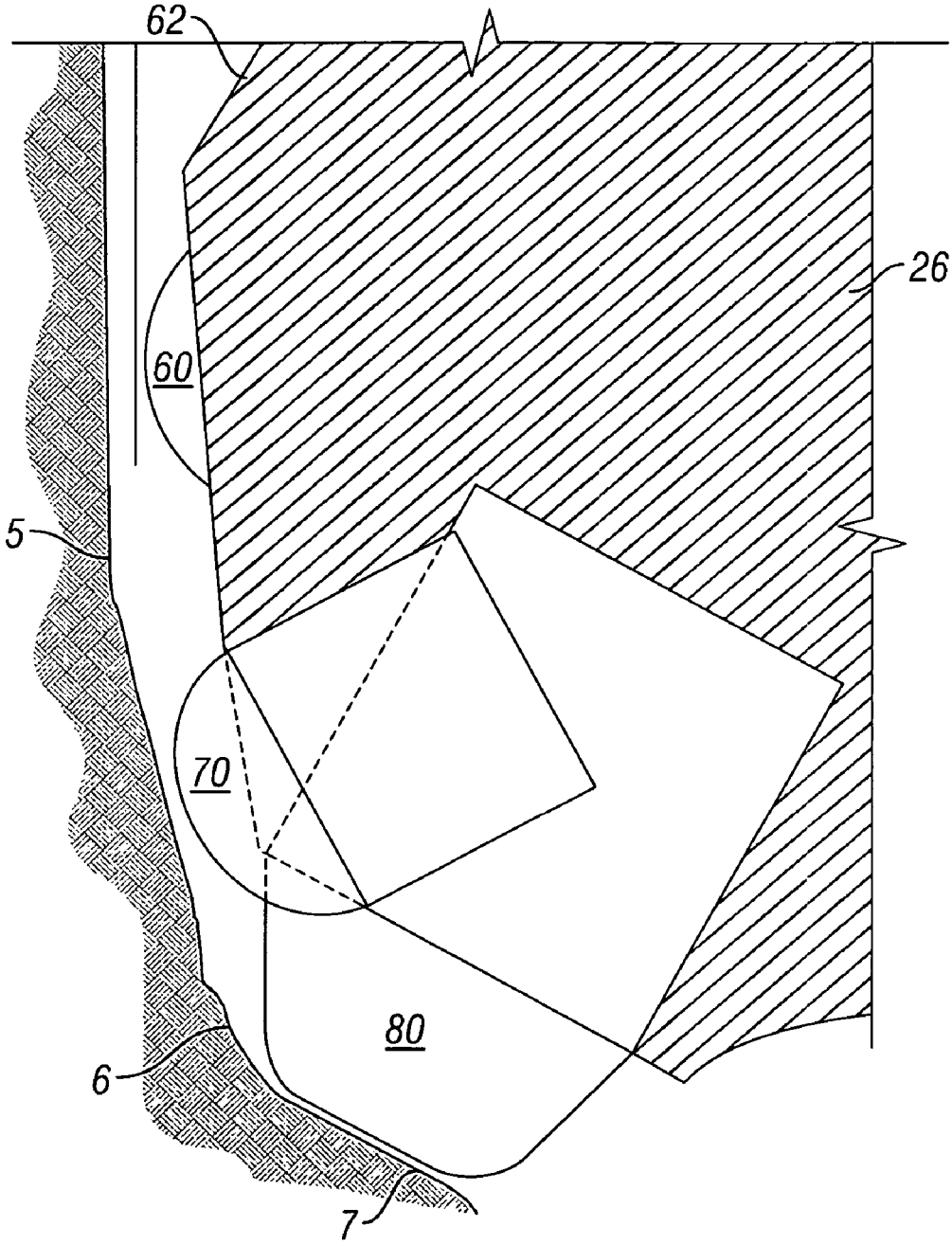
FIG. 3 shows a roller cone drill bit according to one embodiment disclosed herein.

The use of localized or asymmetric material composites for a cutting element may be used on a variety of cutting elements, include gage and inner row elements. As shown in FIG. 3, a roller cone of a drill bit is illustrated. Cone 26 includes a plurality of heel row inserts 60 and gage inserts 70 having base portions secured by interference fit into mating sockets drilled into cone 26, and cutting portions connected to the base portions having cutting surfaces that extend for cutting formation material. Cone 26 further includes a plurality of radially-extending, inner row cutting elements 80. Heel inserts 60 generally function to scrape or ream the borehole sidewall 5 to maintain the borehole at full gage and prevent erosion and abrasion of heel surface 62. Inner row cutting elements 80 are employed primarily to gouge and remove formation material from the borehole bottom 7. Gage inserts 70 and the upper portion of first inner row teeth 80 cooperate to cut the corner 6 of the borehole.

Figure 4:
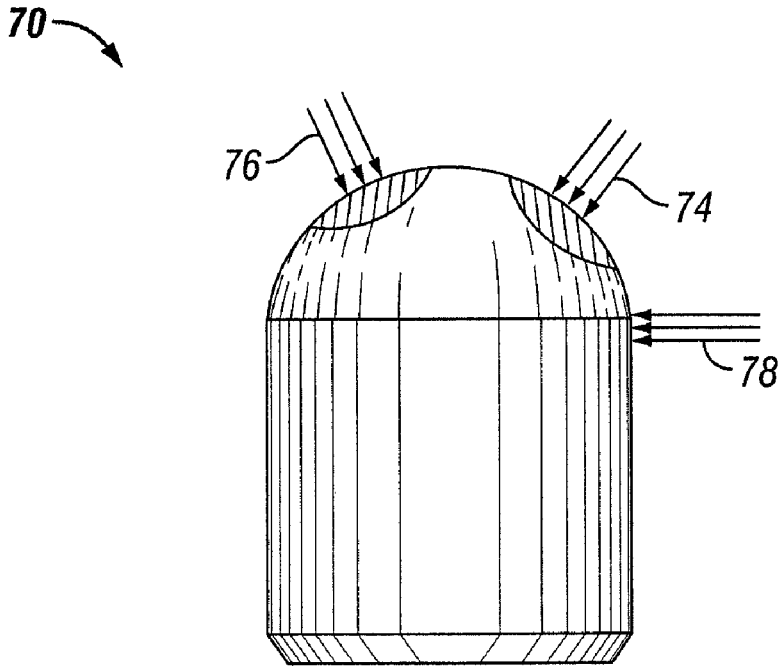
FIG. 4 shows a schematic of an insert illustrating different regions that are prone to wear and fracture.

As described above, in rock drilling applications, cutting elements undergo a variety of stress and wear that may have localized variations in stress depending on factors, such as cutting action and location. Cutting wear and fracture events on an insert or a drill bit are thusly localized and often do not occur at the same locations. For example, as shown in FIG. 4, a gage element 70 may be need to withstand stress 74 related to maintaining the gage diameter in the borehole, stress 76 related to scraping the borehole bottom, and a typical insert protruding bending loads 78.

Figure 5:
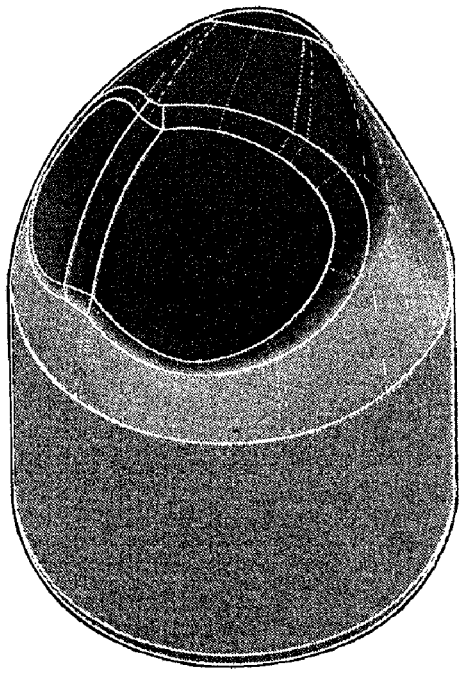
FIG. 5 shows a schematic of an insert illustrating different regions that are prone to wear and fracture.
Figure 6A:
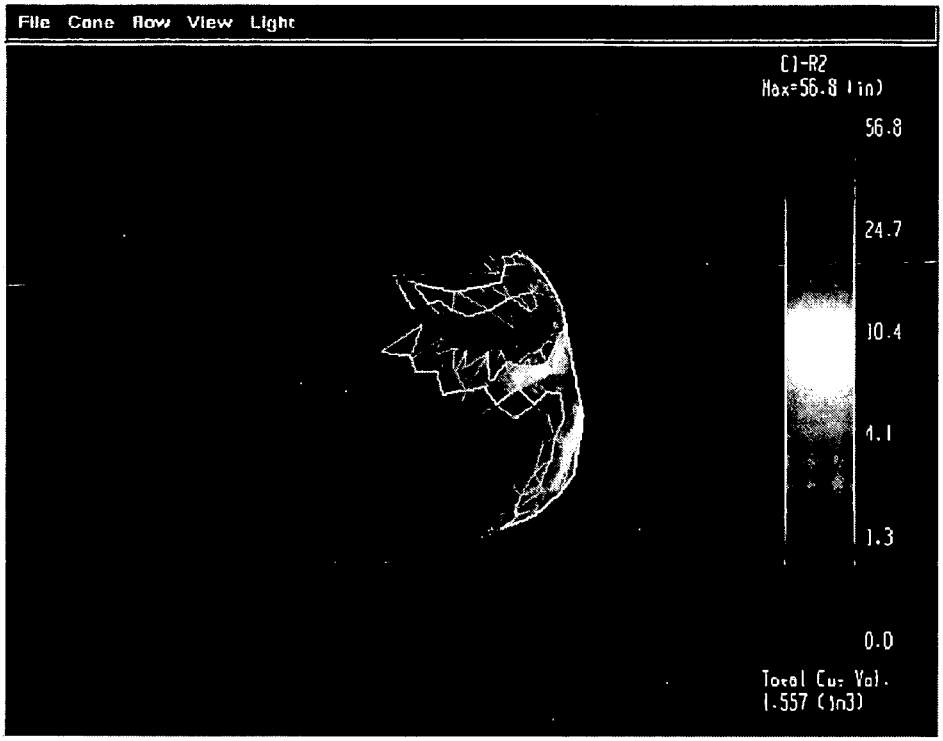
FIGS. 6A and 6B show a side view and a top view of an insert, respectively, illustrating asymmetric load distributions on the insert.
Figure 6B:
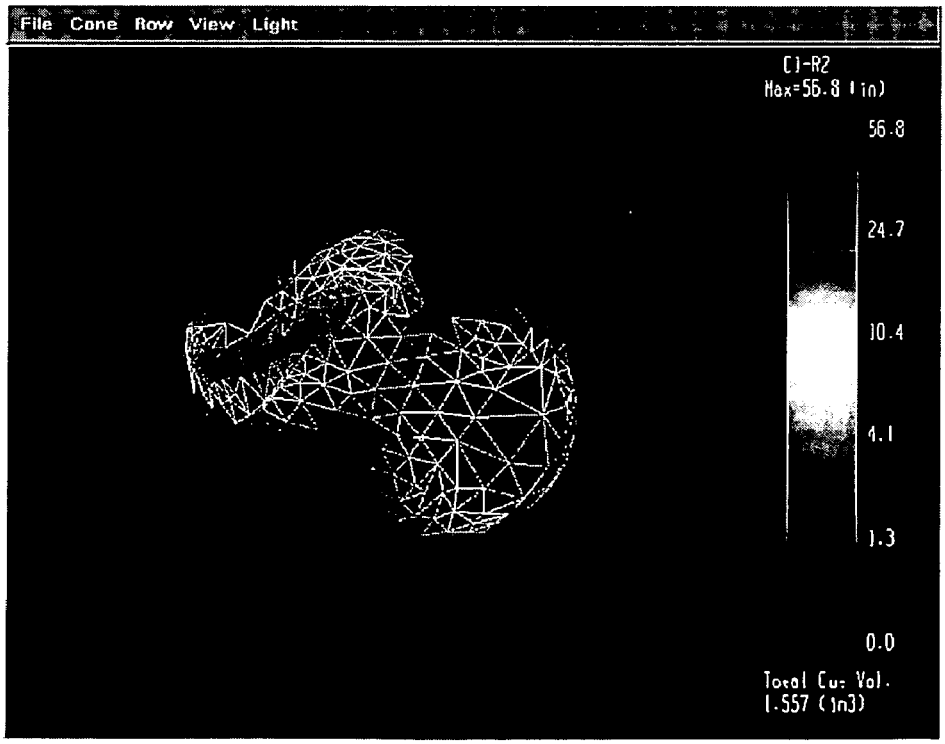

As shown in FIG. 5, the top surface (cutting surface) of an insert may suffer more from wear, while the neck region (the region between the cutting surface and the section held in the insert hole) is more prone to facture. This observation suggests that high levels of wear resistance and fracture resistance are not needed throughout an insert, nor are they needed at the same locations on an insert. Therefore, it is inefficient to optimize the composition for the entire insert because that necessarily leads to a compromise between wear resistance and toughness. Furthermore, due to the asymmetric nature of loading in rock drilling, the regions prone to wear and fracture are not symmetrically located in the insert. This is illustrated in FIGS. 6A (side view) and 6B (top view), which show load distributions on an insert. "Asymmetric" as used herein is with reference to a symmetry element (e.g., a center point, an axis or a plane) of an insert. As shown in FIGS. 6A and 6B, load distributions on this particular insert are asymmetric with respect to the longitudinal axis of the insert.

Two approaches may be used to produce the desired local variations in the material compositions and properties of an insert. In the first approach, the required variations in the material compositions and properties of the insert may be created from the beginning (i.e., using different materials) and preserved throughout the subsequent processing steps. Alternatively, an insert may be made of a homogenous material, and the desired local variations in the material properties may be created in a later step.

Many prior art methods for producing functionally graded materials fall in the first category. Embodiments of the invention belong to the second category. Although DP™ concept, noted above, also belongs to the second category, this method subjects an entire insert to recarburization treatment, i.e., the DP™ method cannot produce localized variations in material properties. U.S. Pat. No. 6,869,460 issued to Bennett et al. discloses a method for creating binder gradients in a carbide article (e.g., an insert). According to the disclosed method, an insert is formed by standard sintering practices, followed by chemical removal of the binder phase from the surface and near surface regions of the insert. The insert is then heat treated at a temperature of 1300-1350° C. in a carburizing atmosphere, for a time of 5-400 minutes to cause diffusion of the binder phase from the interior into the binder depleted surface regions. Similar to the DP™ process, this method also produces a gradient throughout the insert. In contrast, embodiments of the invention can produce variations in material compositions and properties of an insert in a localized and/or asymmetric manner.

Figure 7:
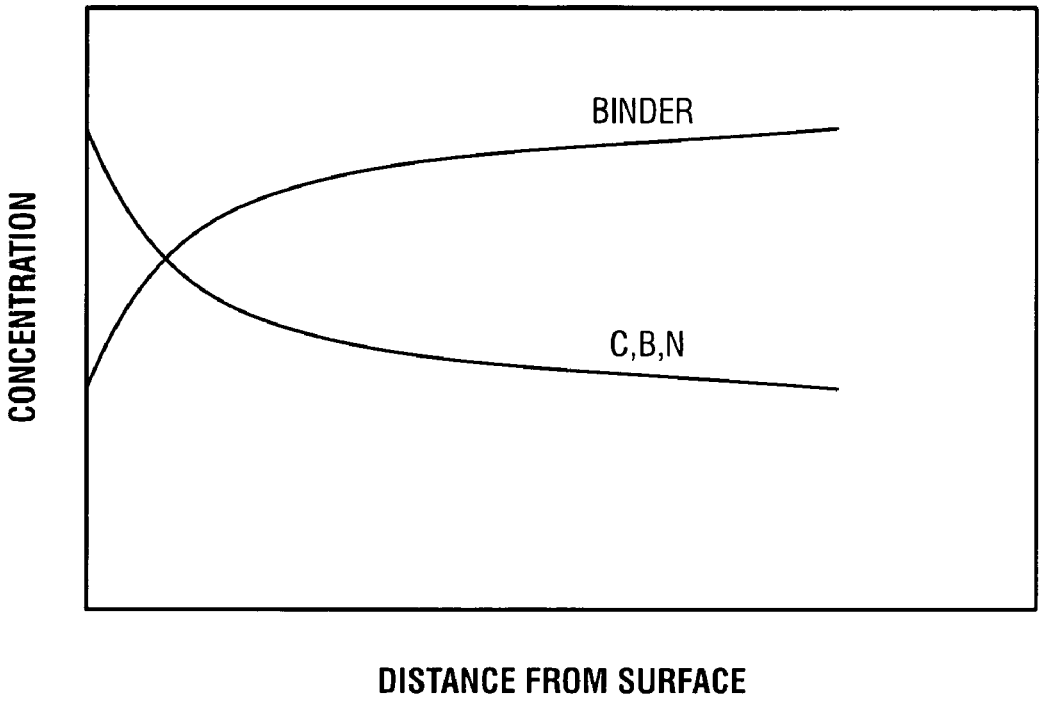
FIG. 7 shows a chart illustrating binder content changes in a cemented tungsten carbide as an interstitial additive is diffused into it.

Embodiments of the invention are based on the observation that generation of binder gradients in cemented tungsten carbides (WC—Co) would produce material property changes in the cemented tungsten carbides, as shown in FIG. 7, and that binder gradients can be generated by diffusion an interstitial agent (an additive), such as carbon, boron, and nitrogen, into the cemented tungsten carbides. For example, carbon gradients may be produced by re-carburization of cemented tungsten carbides that may have been intentionally under-carburized. Examples of cemented tungsten carbides having carbon gradients include the DP™ carbides available from Sandvik AB Corporation (Sandviken, Sweden). DP™ carbides are produced by recarburization of cemented tungsten carbides that creates a carbon gradient near the surface. The carbon gradient near the surface results in a binder gradient, leading to property changes in the cemented tungsten carbides.

Similarly, nitrogen gradients may be generated, for example, by adding a decomposable nitride to the cemented tungsten carbides. The decomposable nitride will produce low nitrogen contents in the cemented tungsten carbides near the surface when heated to high temperatures. This nitrogen gradient in turn produces alloy carbide depletion and binder enrichment near the surface. Metal cutting inserts with nitrogen gradients generated near the surfaces have been shown to produce binder-enriched surfaces that have better fracture resistance.

Similarly, boron gradients may be introduced into cemented tungsten carbides to provide altered properties. Boron gradients can be generated using, for example, boron nitride (BN) in an atmosphere furnace. Methods for infusion of boron into cemented carbides can be found, for example, in U.S. Pat. No. 4,961,780 issued to Pennington, Jr. et al. and U.S. Pat. No. 5,116,416 issued to Knox et al. These two patents are incorporated by reference in their entireties. An exemplary method disclosed in these two patents includes sintering tungsten carbides in a continuous stoking furnace in a disassociated ammonia atmosphere at 1450° C. for one hour while surrounded by an alumina sand heavily saturated in carbon and including 1% boron nitride.

Embodiments of the invention are based on a similar concept—creating interstitial gradients to induce binder gradients. However, embodiments of the invention produce localized interstitial gradients, and hence localized binder gradients and localized variations in material properties. In accordance with some embodiments of the invention, localized gradients may be created by coating an insert with a diffusion barrier (i.e., a refractory material) in areas where the interstitial composition are to be maintained (i.e., where no gradient is to be created). Then, a selected additive is diffused into the insert in areas not protected by the refractory material (diffusion barrier). One of ordinary skill in the art would appreciate that a suitable diffusion barrier (refractory material) will depend on the selected additive that is to be used in the diffusion step. In accordance with some embodiments of the invention, materials that can withstand the high temperatures required for additive diffusion (e.g., sintering temperature for the additive material) can be used as refractory materials. For example, group IV, group V and most group VI transition metal carbides, nitrides, or carbonitrides may be used as refractory materials to coat the inserts and create localized gradients of material properties. In accordance with one embodiment of the invention, titanium nitride (TiN) is used as a refractory material, particularly when boron is selected as the additive.

To illustrate a method in accordance with one embodiment of the invention, rectangular bars of WC—Co (1.5 inch×1 inch×0.25 inch in size; about 10 wt. % Co) were coated with a refractory material (e.g., TiN) using a suitable method, such as physical vapor deposition (PVD), to a proper thickness (e.g., about 2 μm) on all sides except one. One of ordinary skill in the art would appreciate that other suitable coating methods, such as chemical vapor deposition (CVD), may also be used without departing from the scope of the invention. In general, particular coating methods may be selected based on the properties of the refractory materials used.

The coated bars were treated to produce a gradient in boron concentration near the uncoated side. The boron treatment may use any method known in the art. One example method for the introduction of boron into cemented tungsten carbides is disclosed in U.S. Pat. Nos. 4,961,780 and 5,116,416, noted above. The method disclosed in these patents, as described above, has been used to produce Dyanite™ tungsten carbides, which is a trade name of Credo Co., a part of the Vermont American Corporation (Louisville, Ky.).

Dyanite™ is a WC—Co composition modified by addition of boron (B). The microstructure of Dyanite™ consists of WC grains distributed in the cobalt (binder) matrix, along with a boron-rich phase containing W, Co, B and carbon (C). For a given cobalt content and WC grain size, Dyanite™ has a slightly higher hardness and a substantially increased fracture toughness.

Figure 8:
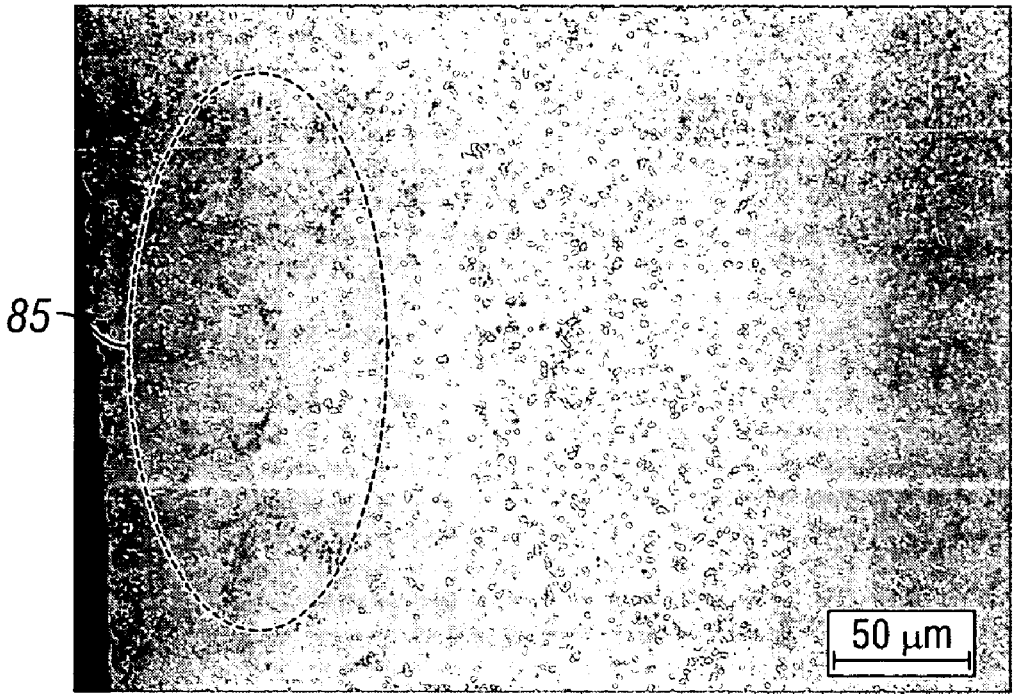
FIG. 8 shows a cemented tungsten carbide having boron diffused into it in accordance with one embodiment of the invention.
Figure 9:
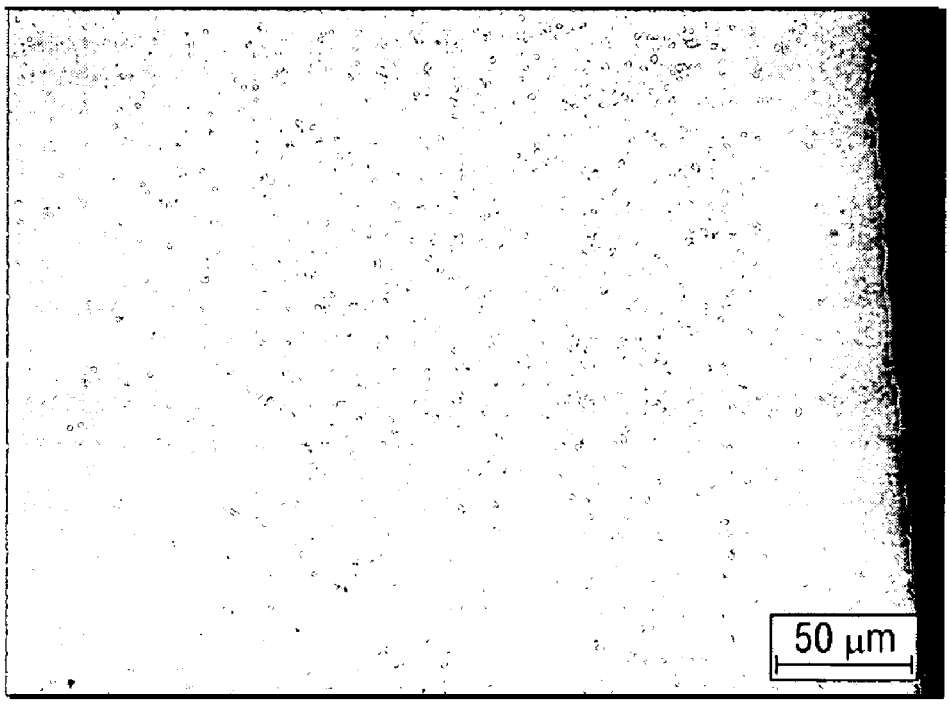
FIG. 9 shows that the refractory material (TiN) successfully prevents boron diffusion into regions coated with it in accordance with one embodiment of the invention.

The microstructures of the test bars after boron treatment are shown in FIGS. 8 and 9. FIG. 8 shows areas on the uncoated sides, and FIG. 9 shows the coated sides. The dark areas in FIG. 8 (uncoated sides), shown in 85 includes boron-rich phase that resulted from boron treatment. The dark areas are absent on the coated sides (FIG. 9), indicating that the refractory coating (TiN) acted as a diffusion barrier to successfully prevent the diffusion of boron into the coated sides.

Figure 10:
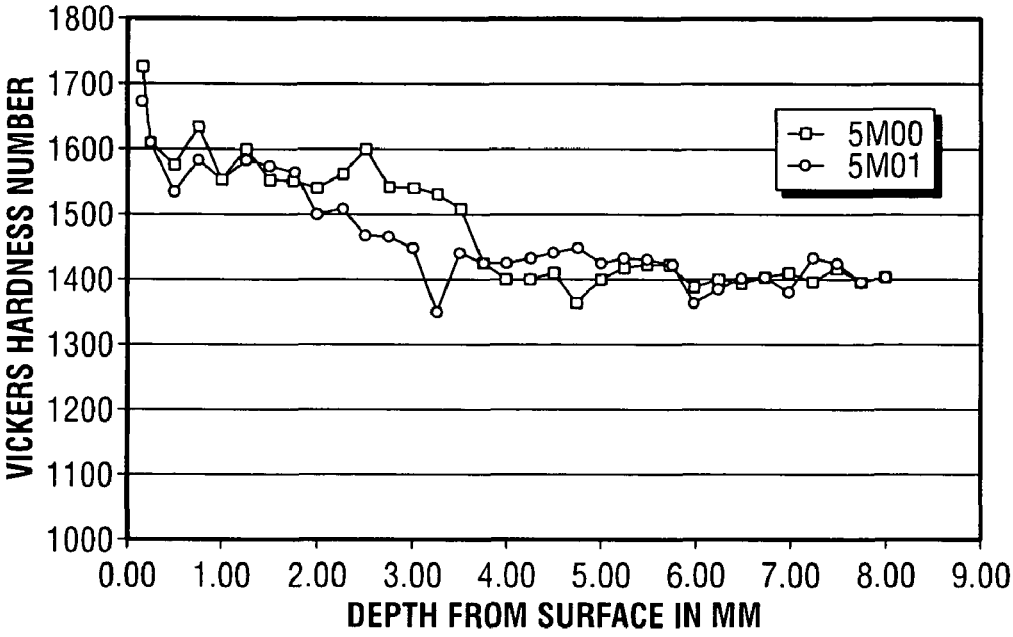
FIG. 10 shows variations in hardness as a function of variations in boron diffusion as in Dyanite™ cemented carbides.

As shown in FIG. 7, binder gradients in cemented tungsten carbides may be created by generation of gradients of an additive (e.g., C, B, or N). It is known that alteration of binder compositions will result in property changes in the cemented tungsten carbides. For example, significant hardness gradients were previously found in low-cobalt content WC—Co samples that had been Dyanite™ treated, as shown in FIG. 10. Accordingly, the local concentration gradients in boron, as seen in FIG. 8, are expected to result in local hardness gradients. Indeed, hardness gradients in boron diffused WC—Co were detected in these samples, albeit not very large (data not shown). The low hardness gradients observed in this example is most likely due to the relatively high cobalt contents in the starting cemented carbide samples because the degree of binder gradient created will be relatively less significant when the starting binder concentration is high.

The above description illustrates some embodiments of the invention, which relate to inserts having localized material property changes. Some embodiments of the invention relate to dill bits having inserts that include local variations in material properties therein. The drill bits may be fixed cutter drill bits or roller cone drill bits. In addition, some embodiments of the invention relate to methods for generating localized (and/or asymmetric) variations in a material property of an insert.

Figure 11:
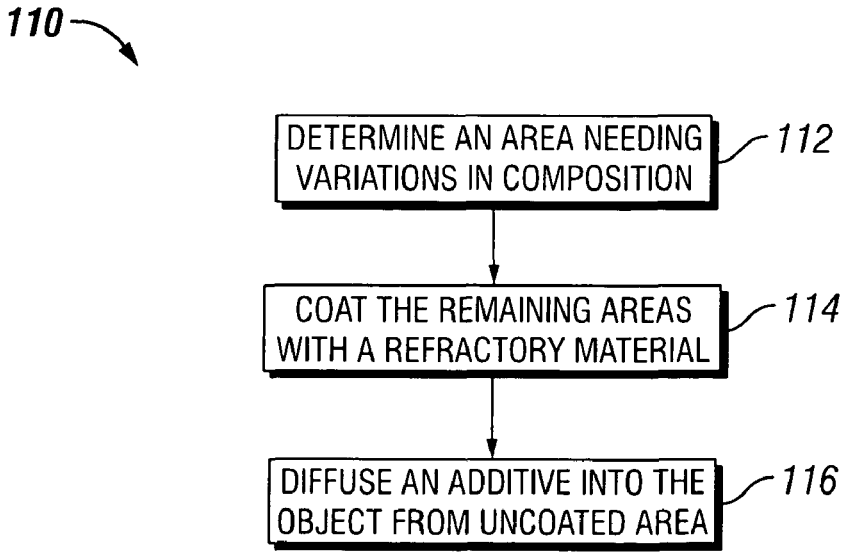
FIG. 11 shows a flow chart of a method for producing localized variations in material properties in accordance with one embodiment of the invention.

FIG. 11 shows a method 110 in accordance with one embodiment of the invention for forming localized material property gradient in an insert. As shown, the areas on an insert in need of altered material properties (e.g., enhanced hardness or enhanced fracture toughness) are determined (shown at 112). This determination may be based on simulation of the insert performance in drilling a selected formation or from prior examination of inserts used in drilling operations. Note that these areas may be asymmetric with respect to an axis or a plane of an insert. Once the areas needing altered material properties are determined, the other areas may then be coated with a refractory material, such as TiN (shown at 114). Then, the insert is subjected to additive diffusion treatments in a suitable process (shown at 116). The additive diffusion method will depend on the agent to be diffused. For example, to diffuse boron into cemented tungsten carbides, the method used for the production of the Dyanite™ carbides may be used.

Embodiments of the present invention may also find use in any downhole cutting application in which there exists potential wear failure. Further, while the present disclosure refers to inserts of a drill bit, it is expressly within the scope of the present invention, that the localized or asymmetric material composites disclosed herein may be used in a variety of cutting structures or bodies for cutting structures, and in other downhole cutting tools including, for example, reamers, continuous miners, or various types of drill bits including roller cone bits, drag bits. One of skill in the art would recognize that cutting tools that may be provided with the localized material compositions and properties disclosed herein are not necessarily limited to tools using in oil and gas exploration, but rather include all types of cutting tools used in drilling and mining.

Advantageously, embodiments of the present invention provide methods for producing inserts, roller cones or drill bits having localized variations in material properties (hence localized variations in wear resistance and fracture toughness). An insert having areas of increased wear resistance and fracture toughness where needed would have an improved performance and life because the insert would not have to compromise the wear resistance with the fracture toughness. In addition, methods of the invention can provide such variations in material properties in an asymmetric manner; this can further enhance the selective improvement of wear resistance and fracture toughness according to the need of the particular regions.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cutting tool, comprising:

at least one tungsten carbide cutting element disposed on a support, wherein at least one tungsten carbide cutting element has at least one asymmetrically localized tungsten carbide region having a material property different from the remaining tungsten carbide cutting element, wherein the at least one asymmetrically localized tungsten carbide region having a different material property has at least one selected agent diffused therein, wherein the selected agent is selected from carbon (C), boron (B), and nitrogen (N).

2. The cutting tool of claim 1, wherein the cutting tool is a reamer.

3. The cutting tool of claim 1, wherein the cutting tool is a drill bit comprising:

a bit body;

at least one roller cone mounted on the bit body;

at least one gage element disposed on the at least one roller cone; and at least one tungsten carbide cutting element disposed on the at least one roller cone.

4. A cutting tool, comprising:

at least one gage element disposed on a support;

wherein at least one gage element comprises a gage element material and at least one asymmetrically localized region having a material property different from the remaining gage element material, wherein the at least one asymmetrically localized region having a different material property comprises the gage element material and at least one selected agent diffused therein, wherein the selected agent is selected from carbon (C), boron (B) and nitrogen (N).

5. The cutting tool of claim 4, wherein the cutting tool is a reamer.

6. The cutting tool of claim of claim 4, wherein the cutting tool is a drill bit comprising:

a bit body;

at least one roller cone mounted on the bit body;

at least one gage element disposed on the at least one roller cone; and at least one inner row cutting element disposed on the at least one roller cone.

7. A method for creating localized variation in a material property of a tungsten carbide cutting element, comprising:

determining at least one localized region of a tungsten carbide cutting element needing a variation in a material property different from the remaining region;

coating at least one area on a surface of the tungsten carbide cutting element with a refractory material, wherein the coating leaves at least one uncoated area on the surface of the tungsten carbide cutting element; and treating the coated cutting element with a selected agent to diffuse the selected agent into the at least one uncoated area, creating a binder gradient in the tungsten carbide cutting element in the at least one uncoated area.

8. The method of claim 7, wherein the refractory material is selected from the group consisting of a carbide, a boride, a nitride, or a carbonitride of a group IV, group V, or group VI transition metal, or a mixture thereof.

9. The method of claim 7, wherein the refractory material comprises titanium nitride (TiN).

10. The method of claim 7, wherein the treating comprises heating the cutting element in a furnace in the presence of the selected agent.

11. The method of claim 7, wherein the coating comprises a method selected from physical vapor deposition (PVD) and chemical vapor deposition (CVD).

12. The method of claim 7, wherein the selected agent is selected from the group consisting of boron (B), carbon (C), and nitrogen (N).

* * * * *